US006752945B2

(12) United States Patent
Hernandez et al.

(10) Patent No.: US 6,752,945 B2
(45) **Date of Patent: *Jun. 22, 2004**

(54) PROCESS FOR MAKING POLY (TRIMETHYLENE TEREPHTHALATE) STAPLE FIBERS

(75) Inventors: Ismael A. Hernandez, Clemmons, NC (US); Geoffrey David Hietpas, Newark, DE (US); James M. Howell, Greenville, NC (US); Claudia Schultze, Greenville, DE (US)

(73) Assignee: E. I. du Pont de Nemours and Company, Wilmington, DE (US)

( * ) Notice: Subject to any disclaimer, the term of this patent is extended or adjusted under 35 U.S.C. 154(b) by 251 days.

This patent is subject to a terminal disclaimer.

(21) Appl. No.: 09/934,904

(22) Filed: Aug. 22, 2001

(65) Prior Publication Data

US 2002/0071951 A1 Jun. 13, 2002

Related U.S. Application Data

(60) Provisional application No. 60/231,852, filed on Sep. 12, 2000.

(51) Int. Cl.[7] ..... D01D 5/088; D01D 5/26; D01D 10/02; D01F 6/62; D02G 1/00

(52) U.S. Cl. ..... 264/143; 264/168; 264/210.7; 264/210.8; 264/211.14; 264/211.17; 264/235; 264/235.6; 264/342 RE

(58) Field of Search ..... 264/143, 168, 264/210.7, 210.8, 211.14, 211.17, 235, 235.6, 342 RE

(56) References Cited

U.S. PATENT DOCUMENTS

| | | | |
|---|---|---|---|
| 2,465,319 | A | 3/1949 | Whinfield et al. |
| 3,038,237 | A | 6/1962 | Taylor |
| 3,350,871 | A | 11/1967 | Pierce et al. |
| 3,454,422 | A | 7/1969 | Mead et al. |
| 3,454,460 | A | 7/1969 | Bosley |
| 3,584,103 | A | 6/1971 | Harris |
| 3,671,379 | A | 6/1972 | Evans et al. |
| 3,681,188 | A | 8/1972 | Harris |
| 3,772,137 | A | 11/1973 | Tolliver |
| 3,816,486 | A | 6/1974 | Vail |
| 3,973,383 | A | 8/1976 | Yu |
| 3,998,042 | A | 12/1976 | Reese |
| 4,134,882 | A | 1/1979 | Frankfort et al. |
| 4,159,617 | A | 7/1979 | Allan |
| 4,256,589 | A | 3/1981 | Carver et al. |

(List continued on next page.)

FOREIGN PATENT DOCUMENTS

| | | | |
|---|---|---|---|
| EP | 745 711 | A1 | 12/1996 |
| EP | 1 016 692 | A1 | 5/2000 |
| EP | 1 016 741 | A1 | 5/2000 |
| EP | 1 033 422 | A1 | 9/2000 |
| EP | 1 052 325 | A1 | 11/2000 |
| EP | 1 160 362 | A1 | 12/2001 |
| GB | 1 075 689 | | 7/1967 |
| GB | 1 165 312 | | 9/1969 |
| GB | 1 254 826 | | 11/1971 |
| JP | 52-5320 | | 1/1977 |
| JP | 58-076517 | A | 9/1983 |
| JP | 62-85026 | A | 4/1987 |
| JP | 02-61111 | A | 3/1990 |
| JP | 05-71013 | A | 3/1993 |
| JP | 9-111629 | A | 4/1997 |

(List continued on next page.)

OTHER PUBLICATIONS

"Textile Staple Production", Corterra Polymers, Shell Chemical Company (Copyright Shell 2000).

Ch, Hwo et al., "Opportunities of Corterra PTT fibers in textiles", Reprinted from Chemical Fibers International, vol. 50 (2000) No. 1, Feb. 2000, referencing lecture held at the Polyester 999 World Congress, Oct. 25–28, 1999 in Zurich Switzerland.

H.S. Brown, et al., "Poly(Trimethylene Terephthalate) Polymers for Fibers", Shell Chemical Company (Copyright 1999).

M. Moeman, et al., Corterra Polymers, Value Proposition in Textile Apparel Applications, Shell Chemical Company (Copyright Shell 2001).

P. Casey et al., "Elastic PTT staple spun yarns and fabrics", Research Disclosure 445034 (May 2001).

P. Casey et al., "Staple fibers made from low intrinsic viscosity polytrimethyleneterephthalate", Research Disclosure 445077 (May 2001).

H.L. Traub, et al., "Mechanical properties of fibers made of polytrimethylene terephthalate", Chemical Fibers International, vol. 45, pp. 110–111 (1985).

W. Oppermann, et al., "Fibers Made of Poly(trimethylene terephthalate)", Dornbirn (1995).

(List continued on next page.)

*Primary Examiner*—Leo B. Tentoni
(74) *Attorney, Agent, or Firm*—Mark D. Kuller

(57) ABSTRACT

A process of making polytrimethylene terephthalate staple fibers, including (a) providing polytrimethylene terephthalate, (b) melt spinning the melted polytrimethylene terephthalate at a temperature of 245–285° C. into filaments, (c) quenching the filaments, (d) drawing the quenched filaments, (e) crimping the drawn filaments using a mechanical crimper at a crimp level of 8–30 crimps per inch (3–12 crimps/cm), (f) relaxing the crimped filaments at a temperature of 50–120° C., and (g) cutting the relaxed filaments into staple fibers having a length of about 0.2–6 inches (about 0.5–about 15 cm), and polytrimethylene terephthalate staple fibers, yarns and fabrics. Further, a process of optimizing the crimp take-up of a polytrimethylene terephthalate staple fiber including determining the relationship between denier and crimp take-up and manufacturing staple fibers having a denier selected based upon that determination.

49 Claims, 1 Drawing Sheet

U.S. PATENT DOCUMENTS

| | | | |
|---|---|---|---|
| 4,639,347 | A | 1/1987 | Hancock et al. |
| 4,710,432 | A | 12/1987 | Nishimura et al. |
| 4,725,635 | A | 2/1988 | Okada et al. |
| 4,794,038 | A | 12/1988 | Marcus |
| 4,836,763 | A | 6/1989 | Broaddus |
| 4,850,847 | A | 7/1989 | Samuelson |
| 5,104,725 | A | 4/1992 | Broaddus |
| 5,112,684 | A | 5/1992 | Halm et al. |
| 5,458,971 | A | 10/1995 | Hernandez et al. |
| 5,527,600 | A | 6/1996 | Frankosky et al. |
| 5,645,782 | A | 7/1997 | Howell et al. |
| 5,683,811 | A | 11/1997 | Hernandez et al. |
| 5,723,215 | A | 3/1998 | Hernandez et al. |
| 5,736,243 | A | 4/1998 | Aneja |
| 5,782,935 | A | 7/1998 | Hirt et al. |
| 5,851,665 | A | 12/1998 | Marcus |
| 5,874,372 | A | 2/1999 | Morishita et al. |
| 5,882,794 | A | 3/1999 | Hernandez et al. |
| 5,891,568 | A | 4/1999 | Hartzog et al. |
| 5,970,700 | A | 10/1999 | Scheerer et al. |
| 5,994,451 | A | 11/1999 | Dangayach |
| 6,023,926 | A | 2/2000 | Flynn |
| 6,037,057 | A | 3/2000 | Hartzog et al. |
| 6,250,060 | B1 | 6/2001 | Scheerer et al. |
| 6,287,688 | B1 | 9/2001 | Howell et al. |
| 6,306,498 | B1 | 10/2001 | Yuuki et al. |
| 6,495,254 | B1 | 12/2002 | Abe et al. |
| 2001/0030377 | A1 | 10/2001 | Howell et al. |
| 2001/0030378 | A1 | 10/2001 | Howell et al. |
| 2001/0031356 | A1 | 10/2001 | Howell et al. |

FOREIGN PATENT DOCUMENTS

| | | | |
|---|---|---|---|
| JP | 11-093034 | A | 4/1999 |
| JP | 11-100721 | A | 4/1999 |
| JP | 11-100768 | A | 4/1999 |
| JP | 11-107036 | A | 4/1999 |
| JP | 11-107038 | A | 4/1999 |
| JP | 11-107081 | A | 4/1999 |
| JP | 11-107149 | A | 4/1999 |
| JP | 11-158733 | A | 6/1999 |
| JP | 11-189920 | A | 7/1999 |
| JP | 11-189938 | A | 7/1999 |
| JP | 11-335954 | A | 12/1999 |
| JP | 00-017556A | A | 1/2000 |
| TW | 472091 | | 1/2002 |
| TW | 475013 | | 2/2002 |
| WO | WO 93/11292 | A1 | 6/1993 |
| WO | WO 99/28122 | A1 | 6/1999 |
| WO | WO 99/50483 | A1 | 10/1999 |
| WO | WO 00/03078 | A1 | 1/2000 |
| WO | WO 00/26301 | A1 | 5/2000 |
| WO | WO 00/55537 | A1 | 10/2000 |
| WO | WO 01/07693 | A1 | 2/2001 |
| WO | WO 01/4909 | A1 | 7/2001 |
| WO | WO 01/66837 | A1 | 9/2001 |
| WO | WO 01/66838 | A1 | 9/2001 |
| WO | WO 01/68962 | A2 | 9/2001 |

OTHER PUBLICATIONS

I. M. Ward, et al., "The Mechanical Properties and Structure of Poly(m–methylene Terephthalate) Fibers", Journal of Polymer Science vol. 14, 263–274 (1976).

H. L. Traub, "Synthese und textilchemische Eigenschaften des Poly–Trimethyleneterephthalats", Dissertation Universitat Stuttgart (1994), (Translation).

S. Schauhoff, "New Developments in the Production of Polytrimethylene Terephthalate (PTT)", Man–Made Fiber Year Book (Sep. 1996).

"Corterra® staple fibre for spinning", from Shell Chemical Compani for presentation at 39th international Man–made Fibre Congress, held Dornbirn, Austria (Sep. 13–15, 2000).

U.S. patent application No. 09/518,732, filed Mar. 3, 2000.

U.S. patent application No. 09/795,933, filed Feb. 28, 2001.

U.S. patent application No. 09/518,759, filed Mar. 3, 2000.

U.S. patent application No. 09/795,518, filed Feb. 28, 2001.

U.S. patent application No. 09/795,520, filed Feb. 28, 2001.

U.S. patent application No. 60/187,244, filed Mar. 3, 2000.

U.S. patent application No. 09/796,785, filed Mar. 3, 2001.

U.S. patent application No. 09/855,343, filed May 15, 2001.

Research Disclosure 17410 (Oct. 1978).

International Search Report from counterpart PCT/US01/26680 (Jan. 24, 2002).

Translation of Official Notification Of The Intellectual Property Office (Taiwan), Issuance Date: Dec. 11, 2002.

U.S. patent application No. 09/934,905, filed Aug. 22, 2001.

U.S. patent application No. 09/934,966, filed Aug. 22, 2001.

C. C. Hwo, et al., Nonwovens from Poly(trimethylene terephthalate) Staple, Corterra Polymers, (Shell Chemicals 2000).

J. Bettner, et al., "High productivity staple fiber spinning technology", *Man Made Fibers Year Book* (Aug. 2001).

J. Bettner et al., Zimmer,AG, "High Productivity of Staple Fiber Production", *The Polyester Chain 2001* (Zurich Dec. 23, 2001).

I. Cordes et al., "New Spinning System, Advanced Staple Line Concept Boost Throughtput by 100%", *International Fibers Journal* (1998).

PROCESS FOR MAKING POLY (TRIMETHYLENE TEREPHTHALATE) STAPLE FIBERS

RELATED APPLICATIONS

This application claims priority from U.S. Provisional Patent Application Serial No. 60/231,852, filed Sep. 12, 2000, which is incorporated herein by reference.

FIELD OF THE INVENTION

The invention relates to a process for making poly (trimethylene terephthalate) ("3GT") crimped staple fibers suitable for yarn and other textile applications, to staple fibers, and to yarns and fabrics made from the staple fibers.

BACKGROUND OF THE INVENTION

Polyethylene terephthalate ("2GT") and polybutylene terephthalate ("4GT"), generally referred to as "polyalkylene terephthalates", are common commercial polyesters. Polyalkylene terephthalates have excellent physical and chemical properties, in particular chemical, heat and light stability, high melting points and high strength. As a result they have been widely used for resins, films and fibers.

Polytrimethylene terephthalate ("3GT") has achieved growing commercial interest as a fiber because of the recent developments in lower cost routes to 1,3-propane diol (PDO), one of the polymer backbone monomer components. 3GT has long been desirable in fiber form for its disperse dyeability at atmospheric pressure, low bending modulus, elastic recovery and resilience.

In many textile end-uses, staple fibers are preferred over continuous filament. These may include staple spun yarns for apparel fabrics, nonwoven materials, and fiberfills and battings. The manufacture of staple fiber suitable for these end uses poses a number of special problems, particularly in obtaining satisfactory fiber crimp, essential for downstream processing such as carding, and in providing a fiber with sufficient toughness (breaking tenacity and abrasion resistance) to produce staple spun yarns with sufficient strength for knitting and weaving for apparel end uses. In the case of 2GT, which is a widely used staple fiber in cotton systems processing as well as in fiberfill and nonwovens applications, these problems are being met by the fiber producers through improvements in polymerization chemistry and optimized fiber production. This has led to improved spinning, drawing and annealing processes tailored to the production of high performance 2GT fibers. There is a need for an improved 3GT staple fiber process which generates fibers with suitable processability in commercial mills employing carding and garnetting processes. The solutions to these problems developed over the years for 2GT or 4GT fibers frequently do not apply to 3GT fibers because of 3GT's unique properties. These needs for tailored fiber properties in a typical 3GT staple yarn spinning process are further described below.

Downstream processing of staple fibers is typically done on cotton systems equipment. This process includes several steps, many of which are done at high speeds and subject the fibers to a significant amount of abrasion, placing demands on the fiber tensile properties. For example, the initial step is fiber opening, which is often done by tumbling the fibers on motorized belts which contain rows of pointed steel teeth for the purposes of pulling and separating large group of fibers. The opened fibers are then conveyed via forced air and, typically, are then passed thorough networks of overhead ductwork or chute feeders. The chute feeders feed the card, a device which separates the fibers and spreads them into a sheet-like layer, which is then fed into a series of rolls containing combing teeth at high speeds. The carded material is then either processed as a web into nonwoven fabrics or fiberfill applications, or is converted into a sliver for conversion into spun yarns. If converted to a sliver, it is then drawn at high speeds to increase uniformity. The draw process reduces the linear density, defined as weight per unit length, typically by a factor of 5 or 6. The drawn sliver is then spun into a yarn. Staple yarn may be spun from the drawn sliver by a number of commercial methods. These include ring spinning, open-end spinning, air jet spinning, and vortex spinning. All of these methods involve high speed twisting of the fibers, and passage of the yarn under tension over contact surfaces (e.g. guides and eyelets) during wind-up of the final yarn.

There are two major criteria for acceptable fibers in the above spun yarn process. The first is that the fibers must be suitable for making yarns of a fineness preferred for fabric and apparel applications. Since by definition, a staple yarn is composed of a series of short discontinuous fibers held together solely by twist and fiber-to-fiber friction, a certain minimum number of fibers, typically 100–180 fibers, are required in the cross section of the textile yarn to give it strength and continuity. This has the effect of limiting the range of the fiber denier per filament (dpf), and restricts the practical range of denier useful to make textile yarns to approximately 3 denier per filament and below. There is in principle no lower limit, but the carding process described above does not perform properly below about 0.8 denier per filament, making the overall practical denier range about 0.8 to about 3 denier per filament (about 0.9 to about 3.3 dtex) for spun yarns. Nonwovens typically utilize about 1.5 to about 6 dpf (about 1.65 to about 6.6 dtex) staple fibers. Higher denier fibers may be required for non-textile applications such as fiberfill, which utilize about 0.8 to about 15 dpf (about 0.88 to about 16.5 dtex) staple fibers.

The second condition is that the fibers must possess a critical set of physical properties to pass through the process with excellent efficiency (minimal fiber damage, nep formation, and various stoppages), while making a yarn, nonwoven fabric, or fiberfill material with sufficient strength for the desired textile end uses. With staple yarns it is especially important they have sufficient strength for knitting and weaving, and sufficient uniformity that they do not cause streaks and unevenness during dyeing and finishing.

For spun yarns containing synthetic fibers, one of the most critical parameters is fiber strength, defined as tenacity or grams of breaking strength per unit denier. It is particularly important in the case of low denier filaments, such as 1 to 3 denier per filament. In the case of 2GT, fiber tenacities of 4 to 7 grams per denier (gpd) are obtainable with low denier filaments. However, in the case of 3GT, typical tenacities are below 3 grams per denier in the low denier region. These fibers with only a few grams of breaking strength are not desirable for staple downstream processing.

There is a need for 3GT staple fibers with tenacities over 3 grams per denier which can be processed into an acceptable staple yarn via spinning techniques such as ring spinning, open end spinning, air jet spinning or vortex spinning. Another important property is the crimp take-up, which is important both for processing the staple fibers and for the properties of textile and fiberfill products made from the staple fibers. The crimp take-up measures the springiness of the fiber as imparted by the mechanical crimping process, and thus affects its handling characteristics such as downstream processing.

While commercial availability of 3GT is relatively new, research has been conducted for quite some time. For instance, British Patent Specification No. 1 254 826 describes polyalkylene filaments, staple fibers and yarns including 3GT filaments and staple fibers. The focus is on carpet pile and fiberfill. The process of Example 1 was used to make 3GT fibers. It describes passing a filament bundle into a stuffer box crimper, heat setting the crimped product in tow form by subjecting it to temperatures of about 150° C. for a period of 18 minutes, and cutting the heat-set tow into 6 inch staple lengths.

EP 1 016 741 describes using a phosphorus additive and certain 3GT polymer quality constraints for obtaining improved whiteness, melt stability and spinning stability. The filaments and short fibers prepared after spinning and drawing are heat treated at 90–200° C. This document does not teach a process for making a high tenacity crimped 3GT staple fiber.

JP 11-107081 describes relaxation of 3GT multifilament yarn unstretched fiber at a temperature below 150° C., preferably 110–150° C., for 0.2–0.8 seconds, preferably 0.3–0.6 seconds, followed by false twisting the multifilament yarn. This document does not teach a process for making a high tenacity crimped 3GT staple fiber.

JP 11-189938 teaches making 3GT short fibers (3–200 mm), and describes a moist heat treatment step at 100–160° C. for 0.01 to 90 minutes or dry heat treatment step at 100–300° C. for 0.01 to 20 minutes. In Working Example 1, 3GT is spun at 260° C. with a yarn-spinning take-up speed of 1800 m/minute. After drawing the fiber is given a constant length heat treatment at 150° C. for 5 minutes with a liquid bath. Then, it is crimped and cut. Working Example 2 applies a dry heat treatment at 200° C. for 3 minutes to the drawn fibers.

U.S. Pat. No. 3,584,103 describes a process for melt spinning 3GT filaments having asymmetric birefringence. Helically crimped textile fibers of 3GT are prepared by melt spinning filaments to have asymmetric birefringence across their diameters, drawing the filaments to orient the molecules thereof, annealing the drawn filaments at 100–190° C. while held at constant length, and heating the annealed filaments in a relaxed condition above 45° C., preferably at about 140° C. for 2–10 minutes, to develop crimp. All of the examples demonstrate relaxing the fibers at 140° C.

All of the documents described above are incorporated herein by reference in their entirety.

None of these documents teach 3GT staple fibers suitable for textile applications or a process for making them.

SUMMARY OF THE INVENTION

The invention is directed to a process of making a polytrimethylene terephthalate staple fibers, comprising:

(a) providing polytrimethylene terephthalate, (b) melt spinning the melted polytrimethylene terephthalate at a temperature of 245–285° C. into filaments, (c) quenching the filaments, (d) drawing the quenched filaments, (e) crimping the drawn filaments using a mechanical crimper at a crimp level of 8–30 crimps per inch (3–12 crimps/cm), (f) relaxing the crimped filaments at a temperature of 50–120° C., and (g) cutting the relaxed filaments into staple fibers having a length of about 0.2–6 inches (about 0.5–about 15 cm).

The temperature of the relaxation is preferably about 105° C. or below, more preferably about 100° C. or below and most preferably about 80° C. or below. Preferably, the temperature of the relaxation is about 55° C. or above, more preferably about 60° C. or above.

Preferably, the relaxation is carried out by heating the crimped filaments in an unconstrained condition.

In one preferred embodiment, the drawn filaments are annealed at 85–115° C. before crimping. Preferably, annealing is carried out under tension using heated rollers. Preferably, the resultant staple fibers have a tenacity of at least 4.0 grams/denier (3.53 cN/dtex) or higher. Preferably, the resultant staple fibers have an elongation of 55% or less.

Preferably, the staple fibers are 0.8–6 denier per filament. In one preferred embodiment, the staple fibers are 0.8–3 denier per filament.

The crimp take-up (%) is a function of fiber properties and is preferably 10% or more, more preferably 15% or more, and most preferably 20% or more, and preferably is up to 40%, more preferably up to 60%.

In another preferred embodiment, the process is carried out without annealing. Preferably, the resultant staple fibers have a tenacity of at least 3.5 grams/denier (3.1 cN/dtex).

The invention is also directed to a polytrimethylene terephthalate staple fiber of 0.8 to 3 denier per filament having a length of about 0.2 to 6 inches (about 0.5 to about 15 cm), a tenacity of 3.5 grams/denier (3.1 cN/dtex) or more and a crimp take-up of 10–60%, containing 8 to 30 crimps per inch (about 3 to about 12 crimps/cm), prepared without annealing.

The invention is further directed to a 0.8 to 3 denier per filament polytrimethylene terephthalate staple fiber having a tenacity of 4.0 grams/denier (3.53 cN/dtex) or higher. Such fibers can have tenacities up to 4.6 grams/denier (4.1 cN/dtex) or higher. Preferably, they have an elongation of 55% or less.

In addition, the invention is directed to textile yarns and textile or nonwoven fabrics. The described fibers may also be used for fiberfill applications.

Using the processes of this invention, it is possible to prepare staple fiber and yarn of superior tenacity, softer fabric hand, increased fiber softness, superior moisture transport properties, improved pilling performance and increased stretch and recovery. The preferred fabrics have fuzzy pills (as opposed to hard pills), which results in less pill sensation.

The invention is also directed to blends of the fibers of the invention and cotton, 2GT, nylon, acrylates, polybutylene terephthalate (4GT) and other fibers. Preferred are yarns, nonwoven, woven and knitted fabrics comprising fibers selected from the group consisting of cotton, polyethylene terephthalate, nylon, acrylate and polybutylene terephthalate fibers.

The invention is also directed to a process of preparing a polytrimethylene terephthalate staple fiber having a desirable crimp take-up comprising (a) determining the relationship between denier and crimp take-up and (b) manufacturing staple fibers having a denier selected based upon that determination.

DETAILED DESCRIPTION OF THE INVENTION

Figure 1:
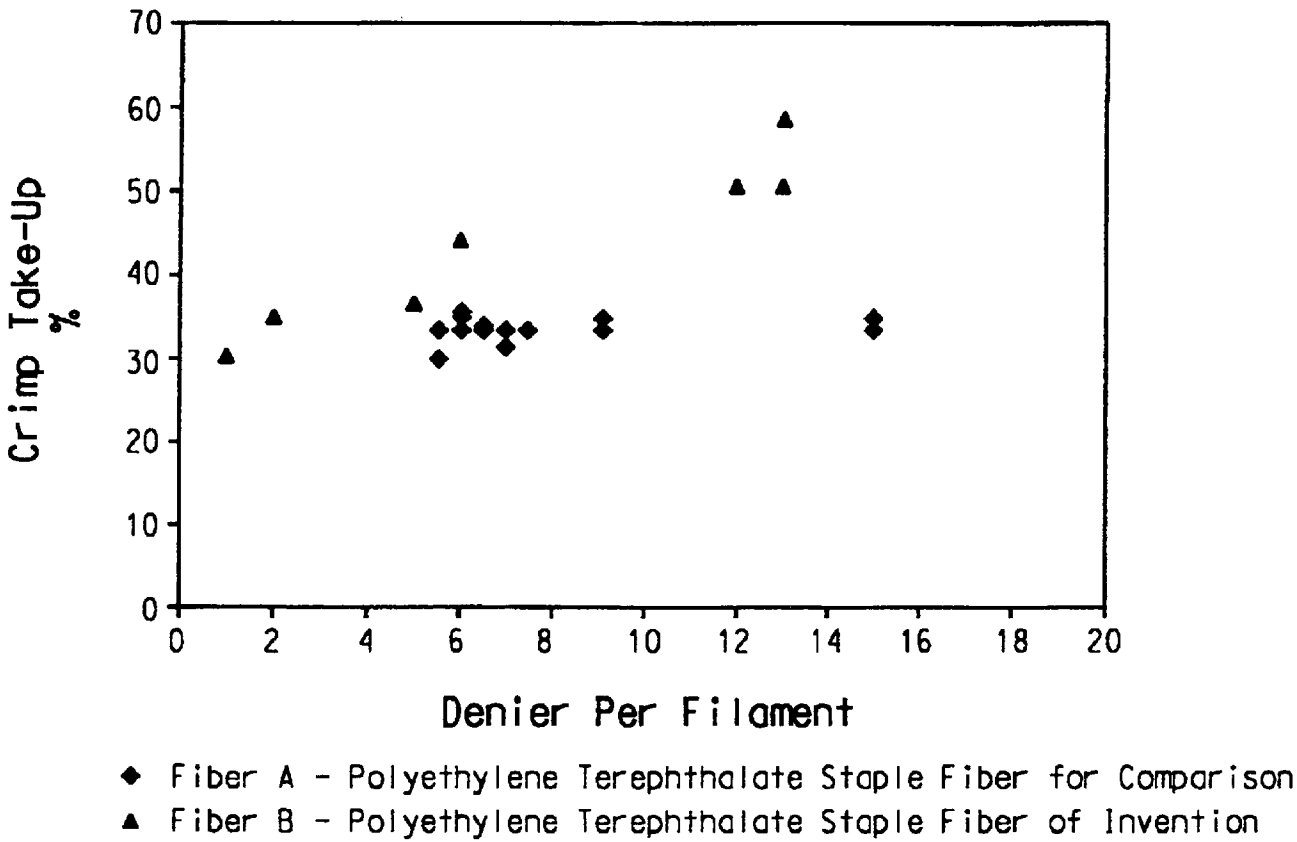
FIG. 1 is a scatter chart showing the relationship between crimp take-up and denier for fibers of the invention and further showing the absence of such relationship in fibers previously known in the art.

The invention is directed to a process for preparing drawn, crimped staple polytrimethylene terephthalate fibers.

Polytrimethylene terephthalate useful in this invention may be produced by known manufacturing techniques (batch, continuous, etc.), such as described in U.S. Pat. Nos. 5,015,789, 5,276,201, 5,284,979, 5,334,778, 5,364,984, 5,364,987, 5,391,263, 5,434,239, 5,510,454, 5,504,122, 5,532,333, 5,532,404, 5,540,868, 5,633,018, 5,633,362, 5,677,415, 5,686,276, 5,710,315, 5,714,262, 5,730,913, 5,763,104, 5,774,074, 5,786,443, 5,811,496, 5,821,092, 5,830,982, 5,840,957, 5,856,423, 5,962,745, 5,990265, 6,140,543, 6,245,844, 6,255,442, 6,277,289, 6,281,325 and 6,066,714, EP 998 440, WO 00/58393, 01/09073, 01/09069, 01/34693, 00/14041, 01/14450 and 98/57913, H. L. Traub, "Synthese und textilchemische Eigenschaften des Poly-Trimethyleneterephthalats", Dissertation Universitat Stuttgart (1994), S. Schauhoff, "New Developments in the Production of Polytrimethylene Terephthalate (PTT)", Man-Made Fiber Year Book (September 1996), and U.S. patent application Ser. Nos. 09/501,700 (now U.S. Pat. No. 6,353,062 B1), 09/502,322 (now U.S. Pat. No. 6,312,805 B1), 09/502,642 and 09/503,599, all of which are incorporated herein by reference. Polytrimethylene terephthalates useful as the polyester of this invention are commercially available from E. I. du Pont de Nemours and Company, Wilmington, Del. under the trademark "Sorona".

The polytrimethylene terephthalate suitable for this invention has an intrinsic viscosity of at 0.60 deciliters/gram (dl/g) or higher, preferably at least 0.70 dl/g, more preferably at least 0.80 dl/g and most preferably at least 0.90 dl/g. The intrinsic viscosity is typically about 1.5 dl/g or less, preferably 1.4 dl/g or less, more preferably 1.2 dl/g or less, and most preferably 1.1 dl/g or less. Polytrimethylene terephthalate homopolymers particularly useful in practicing this invention have a melting point of approximately 225–231° C.

Spinning can be carried out using conventional techniques and equipment described in the art with respect to polyester fibers, with preferred approaches described herein. For instance, various spinning methods are shown in U.S. Pat. Nos. 3,816,486 and 4,639,347, U.S. patent application Ser. No. 09/855,343, filed May 15, 2001 (published as U.S. 2002/0051880 A1), British Patent Specification No. 1 254 826 and JP 11-189938, all of which are incorporated herein by reference.

The spinning speed is preferably 600 meters per minute or more, and typically 2500 meters per minute or less. The spinning temperature is typically 245° C. or more and 285° C. or less, preferably 275° C. or less. Most preferably the spinning is carried out at about 255° C.

The spinneret is a conventional spinneret of the type used for conventional polyesters, and hole size, arrangement and number will depend on the desired fiber and spinning equipment.

Quenching can be carried out in a conventional manner, using air or other fluids described in the art (e.g., nitrogen). Cross-flow, radial or other conventional techniques may be used. Asymmetric quench or other techniques for achieving asymmetric birefringence fibers described in U.S. Pat. No. 3,584,103 (incorporated herein by reference) are not used with this invention.

Conventional spin finishes are applied after quenching via standard techniques (e.g., using a kiss roll).

The melt-spun filaments are collected on a tow can. Then, several tow cans are placed together and a large tow is formed from the filaments. After this, the filaments are drawn using conventional techniques, preferably at about 50–about 120 yards/minute (about 46–about 110 m/minute). Draw ratios preferably range from about 1.25–about 4, more preferably from 1.25–2.5. Drawing is preferably carried out using two-stage drawing (see, e.g., U.S. Pat. No. 3,816,486, incorporated herein by reference).

A finish can be applied during drawing using conventional techniques.

According to a preferred embodiment, the fibers are annealed after drawing and before crimping and relaxing. By "annealing" is meant that the drawn fibers are heated under tension. Annealing is preferably carried out at least about 85° C., and preferably at about 115° C. or less. Most preferably annealing is carried out at about 100° C. Preferably annealing is carried out using heated rollers. It may also be carried out using saturated steam according to U.S. Pat. No. 4,704,329, which is incorporated herein by reference. According to a second option, annealing is not carried out.

Conventional mechanical crimping techniques can be used. Preferred is a mechanical staple crimper with a steam assist, such as stuffer box.

A finish can be applied at the crimper using conventional techniques.

Crimp level is typically 8 crimps per inch (cpi) (3 crimps per cm (cpc)) or more, preferably 10 cpi (3.9 cpc) or more, and most preferably 14 cpi (5.5 cpc) or more, and typically 30 cpi (11.8 cpc) or less, preferably 25 cpi (9.8 cpc) or less, and more preferably 20 cpi (7.9 cpc) or less. The resulting crimp take-up (%) is a function of fiber properties and is preferably 10% or more, more preferably 15% or more, and most preferably 20% or more, and preferably is up to 40%, more preferably up to 60%.

The inventors have found that lowering the temperature of the relaxation is critical for obtaining maximum crimp take-up. By "relaxation" is meant that the filaments are heated in an unconstrained condition so that the filaments are free to shrink. Relaxation is carried out after crimping and before cutting. Typically relaxation is carried out to take out shrinkage and dry the fibers. In a typical relaxer, fibers rest on a conveyor belt and pass through an oven. The minimum the temperature of the relaxation useful for this invention is 40° C., as lower temperatures will not permit the fiber to dry in a sufficient amount of time. Relaxation is preferably at a temperature of 120° C. or less, more preferably 105° C. or less, even more preferably at 100° C. or less, still more preferably below 100° C., and most preferably below 80° C. Preferably the temperature of the relaxation is 55° C. or above, more preferably above 55° C., more preferably 60° C. or above, and most preferably above 60° C. Preferably the relaxation time does not exceed about 60 minutes, more preferably it is 25 minutes or less. The relaxation time must be long enough to dry the fibers and bring the fibers to the desired relaxation temperature, which is dependant on the size of the tow denier and can be seconds when small quantities (e.g., 1,000 denier (1,100 dtex)) are relaxed. In commercial settings, times can be as short as 1 minute. Preferably the filaments pass through the oven at a rate of 50–200 yards/minute (46–about 183 meters/minute) for 6–20 minutes or at other rates suitable to relax and dry the fibers.

Preferably the filaments are collected in a piddler can, followed by cutting and baling. The staple fibers of this invention are preferably cut by a mechanical cutter following relaxation. Preferably, the fibers are about 0.2–about 6 inches (about 0.5–about 15 cm), more preferably about 0.5–about 3 inches (about 1.3–about 7.6 cm), and most preferably about 1.5 inch (3.81 cm). Different staple length may be preferred for different end uses.

The staple fiber preferably has a tenacity of 3.0 grams/denier (g/d) (2.65 cN/dtex (Conversions to cN/dtex were carried out using 0.883 multiplied by g/d value, which is the industry standard technique.)) or higher, preferably greater than 3.0 g/d (2.65 cN/dtex), to enable processing on high-speed spinning and carding equipment without fiber damage. Staple fibers prepared by drawing and relaxing, but not annealing, have tenacities greater than 3.0 g/d (2.65 cN/dtex), preferably 3.1 g/d (2.74 cN/dtex) or higher. Staple fibers prepared by drawing, relaxing and annealing, have tenacities greater than 3.5 g/d (3.1 cN/dtex), preferably 3.6 g/d (3.2 cN/dtex) or higher, more preferably 3.75 g/d (3.3 cN/dtex) or higher, even more preferably 3.9 g/d (3.44 cN/dtex) or higher, and most preferably 4.0 g/d (3.53 cN/dtex) or higher. Tenacities of up to 6.5 g/d (5.74 cN/dtex) or higher can be prepared by the process of the invention. For some end used, tenacities up to 5 g/d (4.4 cN/dtex), preferably 4.6 g/d (4.1 cN/dtex), are preferred. High tenacities may cause excessive fiber pilling on textile surfaces. Most notably, these tenacities can be achieved with elongations (elongation to break) of 55% or less, and normally 20% or more.

The fibers prepared according to this invention for apparel (e.g., knitted and woven fabrics) and nonwovens are typically at least 0.8 denier per filament (dpf) (0.88 decitex (dtex)), preferably at least 1 dpf (1.1 dtex), and most preferably at least 1.2 dpf (1.3 dtex). They preferably are 3 dpf (3.3 dtex) or less, more preferably 2.5 dpf (2.8 dtex) or less, and most preferably 2 dpf (2.2 dtex) or less. Most preferred is about 1.4 dpf (about 1.5 dtex). Nonwovens typically utilize about 1.5–about 6 dpf (about 1.65–about 6.6 dtex) staple fibers. Higher denier fibers up to 6 dpf (6.6 dtex) can be used, and even higher deniers are useful for non-textile uses such as fiberfill.

Fiberfill utilizes about 0.8–about 15 dpf (about 0.88–about 16.5 dtex) staple fibers. The fibers prepared for fiberfill are typically at least 3 dpf (3.3 dtex), more preferably at least 6 dpf (6.6 dtex). They typically are 15 dpf (16.5 dtex) or less, more preferably 9 dpf (9.9 dtex) or less.

The fibers preferably contain at least 85 weight %, more preferably 90 weight % and even more preferably at least 95 weight % polytrimethylene terephthalate polymer. The most preferred polymers contain substantially all polytrimethylene terephthalate polymer and the additives used in polytrimethylene terephthalate fibers. (Additives include antioxidants, stabilizers (e.g., UV stabilizers), delusterants (e.g., $TiO_2$, zinc sulfide or zinc oxide), pigments (e.g., $TiO_2$, etc.), flame retardants, antistats, dyes, fillers (such as calcium carbonate), antimicrobial agents, antistatic agents, optical brightners, extenders, processing aids and other compounds that enhance the manufacturing process or performance of polytrimethylene terephthalate.) When used, $TiO_2$ is preferably added in an amount of at least about 0.01 weight %, more preferably at least about 0.02 weight %, and preferably up to about 5% weight %, more preferably up to about 3 weight %, and most preferably up to about 2 weight %, by weight of the polymers or fibers. Dull polymers preferably contain about 2 weight % and semi-dull polymers preferably contain about 0.3 weight %.

The fibers of this invention are monocomponent fibers. (Thus, specifically excluded are bicomponent and multicomponent fibers, such as sheath core or side-by-side fibers made of two different types of polymers or two of the same polymer having different characteristics in each region, but does not exclude other polymers being dispersed in the fiber and additives being present.) They can be solid, hollow or multi-hollow. Round fibers or other shapes can be prepared.

End uses such as yarns and nonwoven materials are typically prepared by opening the bales, optionally blending them with other staple fibers, and carding them. In making nonwovens, the fibers are bonded by standard methods (e.g., thermal bonding, needelepunching, spunlacing, etc.). In making yarns, the carded material is drawn as sliver and spun into a yarn. Then, the yarn is knitted or woven into fabric.

EXAMPLES

Measurements and Units

Measurements discussed herein were made using conventional U.S. textile units, including denier, which is a metric unit. To meet prescriptive practices elsewhere, the U.S. units are reported herein, together with the corresponding metric units in parenthesis.

Specific properties of the fibers were measured as described below.

Relative Viscosity

Relative Viscosity ("LRV") is the viscosity of polymer dissolved in HFIP solvent (hexafluoroisopropanol containing 100 ppm of 98% reagent grade sulfuric acid). The viscosity measuring apparatus is a capillary viscometer obtainable from a number of commercial vendors (Design Scientific, Cannon, etc.). The relative viscosity in centistokes is measured on a 4.75 wt. % solution of polymer in HFIP at 25° C. as compared with the viscosity of pure HFIP at 25° C.

Intrinsic Viscosity

The intrinsic viscosity (IV) was determined using viscosity measured with a Viscotek Forced Flow Viscometer Y900 (Viscotek Corporation, Houston, Tex.) for the polyester dissolved in 50/50 weight % trifluoroacetic acid/methylene chloride at a 0.4 grams/dL concentration at 19° C. following an automated method based on ASTM D 5225-92.

Crimp Take-Up

One measure of a fiber's resilience is crimp take-up ("CTU") which measures how well the indicated frequency and amplitude of the secondary crimp is set in the fiber. Crimp take-up relates the length of the crimped fiber to the length of the extended fiber and thus it is influenced by crimp amplitude, crimp frequency, and the ability of the crimps to resist deformation. Crimp take-up is calculated from the formula:

$$CTU\ (\%)=[100(L_1-L_2)]/L_1$$

wherein $L_1$ represents the extended length (fibers hanging under an added load of 0.13±0.02 grams per denier (0.115±0.018 dN/tex) for a period of 30 seconds) and $L_2$ represents the crimped length (length of the same fibers hanging under no added weight after resting it for 60 seconds after the first extension).

Comparative Example 1

This comparative example is based on processing polyethylene terephthalate ("2GT") using typical 2GT conditions. 2GT fibers, 6 denier per filament (6.6 dtex) round hollow fibers, were produced by melt extruding 21.6 LRV flake in a conventional manner at 297° C., through a 144-hole spinneret at about 16 pph (7 kg/h), with a spinning speed of about 748 ypm (684 mpm), applying a finish, and collecting yarns on tubes. The yarns collected on these tubes were combined into a tow and drawn at about 100 ypm (91 mpm) in a conventional manner using two-stage drawing (see, e.g., U.S. Pat. No. 3,816,486) in a mostly water bath (containing dilute finish). The first draw stage stretched the fiber about 1.5 times in a bath at 45° C. A subsequent draw of about 2.2 times was performed in a bath at 98° C. The fiber was then crimped in a conventional manner, using a conventional mechanical staple crimper, with steam assist. The fiber was crimped using two different crimp levels and two different steam levels. The fibers were then relaxed in a conventional manner at 180° C. The crimp take-up ("CTU") was measured after crimping and is listed below in Table 1.

TABLE 1

Effect of 180° C. Relaxation Temperature on 2GT

| Crimp Level, Cpi (c/cm) | Steam Pressure, psi (kPa) | Relaxation Temp., ° C. | Crimp Take-Up, % |
|---|---|---|---|
| 6 (2) | 15 (103) | 180 | 48 |
| 10 (4) | 15 (103) | 180 | 36 |
| 6 (2) | 50 (345) | 180 | 38 |
| 10 (4) | 50 (345) | 180 | 48 |

Example 1 (Control—High Temperature Relaxer Conditions)

This example illustrates that when staple fibers are prepared using high relaxation temperatures, staple fibers made from 3GT have significantly poorer quality than 2GT staple fibers. 3GT, 6 denier per filament (6.6 dtex) round hollow fibers, were produced using the same processing conditions as the Comparative Example except that, due to the difference in melting point vs. 2GT, the 3GT fibers were extruded at 265° C. The first draw stage stretched the fibers about 1.2 times. The crimp take-up for the 3GT fibers was measured after crimping and is listed below in Table 2.

TABLE 2

Effect of 180° C. Relaxation Temperature on 3GT

| Crimp Level, Cpi (c/cm) | Steam Pressure, Psi (kPa) | Relaxation Temp., ° C. | Crimp Take-Up, % |
|---|---|---|---|
| 6 (2) | 15 (103) | 180 | 13 |
| 10 (4) | 15 (103) | 180 | 11 |
| 6 (2) | 50 (345) | 180 | 13 |
| 10 (4) | 50 (345) | 180 | 14 |

Comparing the results shown in Tables 1 and 2, it is readily observed that, under similar staple processing conditions, the 3GT fibers made with the high relaxation temperatures have much lower recovery and mechanical strength than 2GT fibers. These properties are essential for many staple fiber products, making the above 3GT results generally marginal or unsatisfactory.

Comparative Example 2

This comparative example is based on processing 2GT using the inventive processing conditions for 3GT.

In this example, 2GT fibers of about 6 denier per filament (6.6 dtex) were spun in a conventional manner at about 92 pph (42 kg/h), at 280° C., using a 363-hole spinneret and about 900 ypm (823 mpm) spinning speed and collected on tubes. The yarns collected on these tubes were combined into a tow and drawn at about 100 ypm (91 mpm) in a conventional manner using two-stage drawing in a mostly water bath. The first draw stage stretched the fiber about 3.6 times in a bath at 40° C. A subsequent draw of about 1.1 times was performed in a bath at 75° C. The fibers were then crimped in a conventional manner, using a conventional mechanical staple crimper, with steam assist. The fibers were crimped to about 12 cpi (5 c/cm), using about 15 psi (103 kPa) of steam. The fibers were then relaxed in a conventional manner at several temperatures. Crimp take-up, measured after crimping, is shown in Table 3.

TABLE 3

Effect of Lower Relaxation Temperatures on 2GT at 12 cpi (5 c/cm)

| Steam Pressure, psi (kPa) | Relaxation Temp., ° C. | Crimp Take-Up, % |
|---|---|---|
| 15 (103) | 100 | 32 |
| 15 (103) | 130 | 32 |
| 15 (103) | 150 | 29 |
| 15 (103) | 180 | 28 |

The 2GT shows only a slight decrease in recovery as measured by crimp increased relaxation temperature.

Example 2

In this example, 3GT fibers, 4.0 denier per filament (4.4 dtex) round fibers, were produced by melt extruding flake in a conventional manner at 265° C., through a 144-hole spinneret at about 14 pph (6 kg/h), with a spinning speed of about 550 pm (503 mpm), applying a finish and collecting the yarns on tubes. These yarns were combined into a tow and drawn at about 100 ypm (91 mpm) in a conventional manner using two-stage drawing in a mostly water bath. The first draw stages stretched the fiber about 3.6 times in a mostly water bath at 45° C. A subsequent draw of about 1.1 times was performed in a bath at either 75° C. or 98° C. The fiber was then crimped in a conventional manner, using a conventional mechanical staple crimper, with steam assist. The fiber was crimped to about 12 cpi (5 c/cm) using about 15 psi (103 kPa) of steam. The fibers were then relaxed in a conventional manner at several temperatures. The crimp take-up was measured after crimping and is listed below in Table 4.

TABLE 4

Effect of Lower Relaxation Temperatures on 3GT at 12 cpi (5 c/cm)

| Bath Temp., ° C. | Steam Pressure, psi (kPa) | Relaxation Temp., ° C. | Crimp Take-Up, % |
|---|---|---|---|
| 75 | 15 (103) | 100 | 35 |
| 75 | 15 (103) | 130 | 24 |
| 75 | 15 (103) | 150 | 14 |
| 75 | 15 (103) | 180 | 11 |
| 98 | 15 (103) | 100 | 35 |
| 98 | 15 (103) | 130 | 17 |
| 98 | 15 (103) | 150 | 11 |
| 98 | 15 (103) | 180 | 9 |

The recovery properties of 3GT, as measured by crimp take-up and illustrated in Table 4, rapidly decreases with increased relaxation temperature. This behvior is surprisingly different from the behavior of 2GT, which as shown in Table 3, experiences only slight decrease in recovery with increased relaxation temperature. This surprising result was duplicated even when using a bath temperature of 98° C. for the second drawing stage, as shown in Table 4. This example also shows that 3GT fibers made according to the more preferred relaxation temperatures of this invention have superior properties over 2GT fibers.

Example 3

This example demonstrates another surprising correlation found with the 3GT fibers of the invention: varying the denier of the filaments. 3GT fibers of different denier and cross sections were made in a manner similar to the previous example. The recovery of the fibers, i.e., crimp take-up, was measured with the results listed in Table 5 below. The fibers were treated with a silicone slickener such as described in U.S. Pat. No. 4,725,635, which is incorporated herein by reference, which cures at 170° C. when held for at least 4 minutes once the moisture has been driven from the tow. At 170° C. the crimp take-up of the fiber is very low. To produce slick fibers, the staple was held at 100° C. for 8 hours to cure the silicone slickener finish.

TABLE 5

Effect of Filament Denier on 3GT

| Filament Denier (dtex) | Fiber Cross-Section | Crimp Take-Up, % |
|---|---|---|
| 13.0 (14.4) | Round 1-void | 50 |
| 13.0 (14.4) | Triangular | 58 |
| 12.0 (13.3) | Triangular 3-void | 50 |
| 6.0 (6.7) | Round 1-void | 44 |
| 4.7 (5.2) | Round Solid | 36 |
| 1.0 (1.1) | Round Solid | 30 |

As shown in Table 5, the denier of the filaments has a direct impact on the recovery from extension under a constant load per denier, imparted by the mechanical crimp of the filaments. As denier increases, the recovery, i.e., crimp take-up, increases with it. Similar testing with 2GT showed little impact on recovery with changes in denier. This unexpected result is better illustrated in FIG. 1. FIG. 1 plots crimp take-up versus denier per filament for three different types of fibers. Fiber A is a commercially available 2GT fiber. Fiber B is fiber made according to the invention as detailed in Table 5.

As can be seen in FIG. 1, with the 2GT fibers there is little or no change in recovery as denier per filament increases. On the other hand, with the 3GT fibers of the invention, there is a linear increase in recovery as denier per filament increases.

Example 4

This example demonstrates the preferred embodiment of the invention for a mid-denier round cross section staple fiber prepared under a series of processing conditions.

Polytrimethylene terephthalate of intrinsic viscosity (IV) 1.04 was dried over an inert gas heated to 175° C. and then melt spun into an undrawn staple tow through 741 hole spinnerets designed to impart a round cross section. The spin block and transfer line temperatures were maintained at 254° C. At the exit of the spinneret, the threadline was quenched via conventional cross flow air. A spin finish was applied to the quenched tow and it was wound up at 1400 yards/min (1280 meters/min). The undrawn tow collected at this stage was determined to be 5.42 dpf (5.96 dtex) with a 238% elongation to break and having a tenacity of 1.93 g/denier (1.7 cN/dtex). The tow product described above was drawn, optionally annealed, crimped, and relaxed under conditions specified below.

Example 4A

This tow was processed using a two-stage draw-relax procedure. The tow product was drawn via a two-stage draw process with the total draw ratio between the first and the last rolls set to 2.10. In this two stage process, between 80–90% of the total draw was done at room temperature in the first stage, and then the remaining 10–20% of the draw was done while the fiber was immersed in atmospheric steam set to 90–100° C. The tension of the tow line was continually maintained as the tow was fed into a conventional stuffer box crimper. Atmospheric steam was also applied to the tow band during the crimping process. After crimping, the tow band was relaxed in a conveyer oven heated to 56° C. with a residence time in the oven of 6 minutes. The resulting tow was cut to a staple fiber which had a dpf of 3.17 (3.49 dtex). While the draw ratio was set to 2.10 as described above, the reduction in denier from undrawn tow (5.42 dpf) to final staple form (3.17 dpf) suggests a true process draw ratio of 1.71. The difference is caused by shrinkage and relaxation of the fiber during the crimping and relaxer steps. The elongation to break of the staple material was 87% and the fiber tenacity was 3.22 g/denier (2.84 cN/dtex). The crimp take-up of the fiber was 32% with 10 crimp/inch (3.9 crimp/cm).

Example 4B

This tow was processed the using a single stage draw-relax procedure. The tow product was processed similar to Example 4A with the following modifications. The draw process was done in a single stage while the fiber was immersed in atmospheric steam at 90–100° C. The resulting staple fiber was determined to be 3.21 dpf (3.53 dtex), with an elongation to break of 88%, and the fiber tenacity was 3.03 g/denier (2.7 cN/dtex). The crimp take-up of the fiber was 32% with 10 crimp/inch (3.9 crimp/cm).

Example 4C

This tow was processed using a two stage draw-anneal-relax procedure. The tow product was draw processed similar to Example 4A, except that in the second stage of the draw process the atmospheric steam was replaced by a water spray heated to 65° C., and the tow was annealed under tension at 110° C. over a series of heated rolls before entering the crimping stage. The relaxer oven was set to 55° C. The resulting staple fiber was determined to be 3.28 dpf (3.61 dtex), with an elongation to break of 86%, and the fiber tenacity was 3.10 g/denier (2.74 cN/dtex). The crimp take-up of the fiber was 32% with 10 crimp/inch (3.9 crimp/cm).

Example 4D

This tow was processed using a two stage draw-anneal-relax procedure. The tow product was draw processed similar to Example 4C with the following modifications. The total draw ratio was set to 2.52. The annealing temperature was set to 95° C. and the relaxer oven was set to 65° C. The resulting staple fiber was determined to be 2.62 dpf (2.88 dtex), with an elongation to break of 67%, and the fiber tenacity was 3.90 g/denier (3.44 cN/dtex). The crimp take-up of the fiber was 31% with 13 crimp/inch (5.1 crimp/cm).

Example 5

This example demonstrates the preferred embodiment of the invention for a low denier round cross section staple fiber.

Polytrimethylene terephthalate of intrinsic viscosity (IV= 1.04) was dried over an inert gas heated to 175° C. and then melt spun into an undrawn staple tow through 900 hole spinnerets designed to impart a round cross section. The spin block and transfer line temperatures were maintained at 254° C. At the exit of the spinneret, the threadline was quenched via conventional cross flow air. A spin finish was applied to the quenched tow and it was wound up at 1600 yards/min (1460 meters/min.). The undrawn tow collected at this stage was determined to be 1.86 dpf (2.05 dtex) with a 161% elongation to break and having a tenacity of 2.42 g/denier (2.14 cN/dtex).

This tow was processed using a two-stage draw-anneal-relax procedure. The tow product was drawn via a two-stage draw process with the total draw ratio between the first and the last rolls set to 2.39. In this two-stage process, between 80–90% of the total draw was done at room temperature in the first stage, and then the remaining 10–20% of the draw was done while the fiber was immersed in an water spray heated to 65° C. The tow was annealed under tension over a series of hot rolls heated to 95° C. The tension of the tow line was continually maintained as the tow was fed into a conventional stuffer box crimper. Atmospheric steam was applied to the tow band during the crimping process. After crimping, the tow band was relaxed in a conveyer oven heated to 65° C. with a residence time in the oven of 6 minutes. The resulting staple fiber was determined to be 1.12 dpf (1.23 dtex), with an elongation to break of 48%, and the fiber tenacity was 4.17 g/denier (3.7 cN/dtex). The crimp take-up of the fiber was 35% with 14 crimp/inch (5.5 crimp/cm).

Example 6

This example demonstrates preparation of a non-annealed staple fiber using a single stage draw-relax procedure.

Polytrimethylene terephthalate of intrinsic viscosity 1.04, containing 0.27% $TiO_2$, was dried in an inert gas at 140° C. and then melt spun into an undrawn staple tow through 1176 hole spinnerettes designed to impart a round fiber cross section. The spin block and transfer line temperatures were maintained at 254° C. At the exit of the spinnerette, the threadline was quenched via conventional cross flow air. A spin finish was applied to the quenched tow and it was collected at 1400 yards/min. The undrawn tow collected at this stage was determined to be 5.24 dpf (5.76 dtex) with a 311% elongation to break and having a tenacity of 1.57 g/denier (1.39 cN/dtex).

The tow product was drawn via a single stage draw process with the total draw ratio between the first and the last rolls set to 3.00. The tension of the tow line was continually maintained after drawing, while a water spray at 98° C. was applied to the tow. The tow was then fed into a conventional stuffer box crimper. Atmospheric steam and a dilute fiber finish were applied to the tow band during the crimping process. After crimping, the tow band was relaxed in a conveyer oven heated to 60° C. with a residence time in the oven of 6 minutes. At the exit of the relaxer oven, additional dilute finish was applied to the fiber and it was then conveyed to a container and cut into staple. The elongation to break of the resulting staple material was 71.5% and the fiber tenacity was 3.74 g/denier (3.30 cN/dtex). The crimp take-up of the fiber was 15 with a crimp/inch of 12.

The foregoing disclosure of embodiments of the invention has been presented for purposes of illustration and description. It is not intended to be exhaustive or to limit the invention to the precise forms disclosed. Many variations and modifications of the embodiments described herein will be obvious to one of ordinary skill in the art in light of the above disclosure. The scope of the invention is to be defined only by the claims appended hereto, and by their equivalents.

We claim:

1. A process of making polytrimethylene terephthalate staple fibers, comprising (a) providing polytrimethylene terephthalate, (b) melt spinning the melted polytrimethylene terephthalate at a temperature of 245–285° C. into filaments, (c) quenching the filaments, (d) drawing the quenched filaments, (e) crimping the drawn filaments using a mechanical crimper at a crimp level of 8–30 crimps per inch, (f) relaxing the crimped filaments at a temperature of 50–120° C., and (g) cutting the relaxed filaments into staple fibers having a length of about 0.2–6 inches.

2. The process of claim 1 wherein the temperature of the relaxation is below about 105° C.

3. The process of claim 1 wherein the temperature of the relaxation is about 55–about 105° C.

4. The process of claim 1 wherein the temperature of the relaxation is about 60–about 100° C.

5. The process of claim 1 wherein the relaxation is carried out by heating the crimped filaments in an unconstrained condition.

6. The process of claim 1 wherein the drawn filaments are annealed at 85–115° C. before crimping.

7. The process of claim 6 wherein the annealing is carried out under tension using heated rollers.

8. The process of claim 1 wherein the staple fibers are 0.8–6 denier per filament.

9. The process of claim 1 wherein the staple fibers are 0.8–3 denier per filament.

10. The process of claim 9, wherein the drawn filaments are annealed at 85–115° C. before crimping and the staple fibers have a tenacity of at least 4.0 grams/denier or higher.

11. The process of claim 10 wherein the staple fibers have an elongation of 55% or less.

12. The process of claim 1 wherein the process is carried out without annealing the drawn filaments before crimping and the staple fibers have a tenacity of at least 3.5 grams/denier.

13. The process of claim 12 wherein the polytrimethylene terephthalate staple fibers are 0.8–3 denier per filament, have a tenacity of 3.5 grams/denier or more, have a crimp take-up of 10–60%, and contain 8–30 crimps per inch.

14. The process of claim 12 wherein the polytrimethylene terephthalate staple fibers are 0.8–3 denier per filament and have a tenacity of 4.0 grams/denier or higher.

15. The process of claim 14 wherein the polytrimethylene terephthalate staple fibers have an elongation of 55% or less.

16. The process of claim 1 wherein the process further comprises preparing the polytrimethylene terephthalate staple fibers so that they have a desired crimp take-up by (i) determining the relationship between denier and crimp take-up and (ii) manufacturing staple fibers having a denier selected based upon that determination.

17. The process of claim 1 wherein the process is carried out without annealing the drawn filaments before crimping.

18. The process of claim 17 wherein the temperature of the relaxation is below 100° C.

19. The process of claim 17 wherein the temperature of the relaxation is 80° C. or below.

20. The process of claim 18 wherein the relaxation is carried out by heating the crimped filaments in an unconstrained condition.

21. The process of claim 19 wherein the relaxation is carried out by heating the crimped filaments in an unconstrained condition for 1–60 minutes.

22. The process of claim 18 wherein the temperature of the relaxation is 60° C. or above for 1–60 minutes.

23. The process of claim 19 wherein the temperature of the relaxation is 60° C. or above.

24. The process of claim 18 wherein the temperature of the relaxation is 60° C. or above and the relaxation is carried out by heating the crimped filaments in an unconstrained condition by passing the filaments through an oven at a rate of 50–200 yards/minute for 6–20 minutes.

25. The process of claim 19 wherein the temperature of the relaxation is 60° C. or above and the relaxation is carried out by heating the crimped filaments in an unconstrained condition by passing the filaments through an oven at a rate of 50–200 yards/minute for 6–20 minutes.

26. The process of claim 6 wherein the temperature of the relaxation is below 100° C.

27. The process of claim 6 wherein the temperature of the relaxation is 80° C. or below for 1–60 minutes.

28. The process of claim 26 wherein the relaxation is carried out by heating the crimped filaments in an unconstrained condition.

29. The process of claim 27 wherein the relaxation is carried out by heating the crimped filaments in an unconstrained condition.

30. The process of claim 27 wherein the temperature of the relaxation is 60° C. or above for 1–60 minutes.

31. The process of claim 27 wherein the temperature of the relaxation is 60° C. or above.

32. The process of claim 26 wherein the temperature of the relaxation is 60° C. or above and the relaxation is carried out by heating the crimped filaments in an unconstrained condition by passing the filaments through an oven at a rate of 50–200 yards/minute for 6–20 minutes.

33. The process of claim 27 wherein the temperature of the relaxation is 60° C. or above and the relaxation is carried out by heating the crimped filaments in an unconstrained condition by passing the filaments through an oven at a rate of 50–200 yards/minute for 6–20 minutes.

34. The process of claim 26 wherein the annealing is carried out under tension using heated rollers.

35. The process of claim 27 wherein the annealing is carried out under tension using heated rollers.

36. The process of claim 31 wherein the annealing is carried out under tension using heated rollers.

37. The process of claim 34 wherein the annealing is carried out under tension using heated rollers.

38. The process of claim 1 wherein the drawing is carried out using two-stage drawing.

39. The process of claim 38 wherein the two stage drawing comprises (a) a first stage drawing at room temperature and (b) the remaining drawing with the fiber immersed in atmospheric steam set to 90–100° C.

40. The process of claim 39 wherein 80–90% of the total draw is done in the first stage and 10–20% of the drawing is done in the remaining drawing.

41. The process of claim 38 wherein the two stage drawing comprises (a) a first stage drawing at room temperature and (b) the remaining drawing with the fiber immersed in a heated water spray.

42. The process of claim 41 wherein 80–90% of the total draw is done in the first stage and then the remaining 10–20% of the draw is done in the remaining drawing.

43. The process of claim 42 wherein the water spray is heated to 65° C.

44. The process of claim 1 wherein the drawing is carried out using single-stage drawing.

45. The process of claim 44 wherein tension and a water spray are applied to the drawn filament after drawing.

46. The process of claim 1 wherein the drawing is carried out using a draw ratio of about 1.25 –about 4.

47. The process of claim 38 wherein the drawing is carried out using a draw ratio of about 1.25–about 4.

48. The process of claim 40 wherein the drawing is carried out using a draw ratio of about 1.25–about 4.

49. The process of claim 42 wherein the drawing is carried out using a draw ratio of about 1.25–about 4.

* * * * *